United States Patent [19]

Walt

[11] 3,958,382

[45] May 25, 1976

[54] ANCHOR FOR INTERCONNECTING TWO RELATIVELY MOVABLE COMPONENTS OF A STRUCTURE

[75] Inventor: Hans Walt, Paradies, Switzerland

[73] Assignee: Keller AG Ziegeleien, Pfungen, Switzerland

[22] Filed: Oct. 31, 1974

[21] Appl. No.: 519,590

[30] Foreign Application Priority Data

Nov. 2, 1973 Switzerland ..... 15464/73

[52] U.S. Cl. ..... 52/713; 52/709

[51] Int. Cl.[2] ..... E04B 1/38

[58] Field of Search ..... 52/698–714, 52/426, 428, 585–587; 403/56, 62, 73, 74, 75, 76, 111, 114, 113, 115, 117, 121, 132, 144, 166; 248/475

[56] References Cited

UNITED STATES PATENTS

| | | | |
|---|---|---|---|
| 1,761,800 | 6/1930 | Preis | 52/709 X |
| 1,942,863 | 1/1934 | Johnstone | 52/713 X |
| 3,005,292 | 10/1961 | Reiland | 52/710 X |
| 3,635,435 | 1/1972 | Perlson | 403/144 X |

FOREIGN PATENTS OR APPLICATIONS

| | | | |
|---|---|---|---|
| 19,528 | 8/1905 | United Kingdom | 52/713 |

*Primary Examiner*—J. Karl Bell

*Attorney, Agent, or Firm*—Werner W. Kleeman

[57] ABSTRACT

An anchor for interconnecting two relatively movable components of a structure, comprising two anchoring elements which are hingedly connected with one another through the agency of a connection element serving as a compensation component, the two anchoring elements in the traction direction bearing against fixed stops of the connection element. The anchoring elements are held at the stops by means of a support device. When the anchor is not under load the anchoring elements are aligned coaxially relative to one another by means of an aligning device.

7 Claims, 5 Drawing Figures

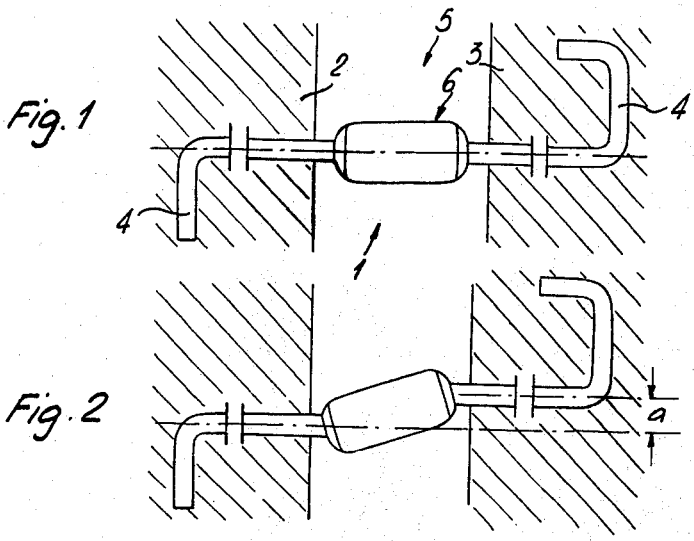
Fig. 1
Fig. 2
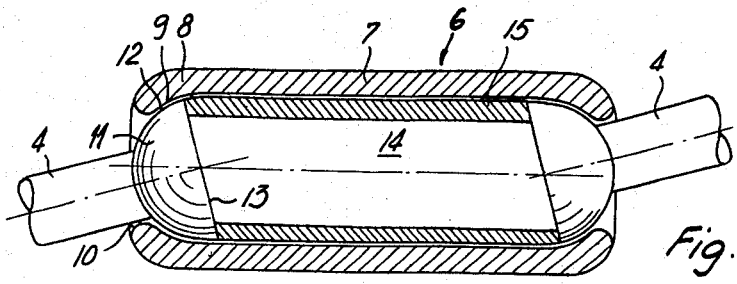
Fig. 3
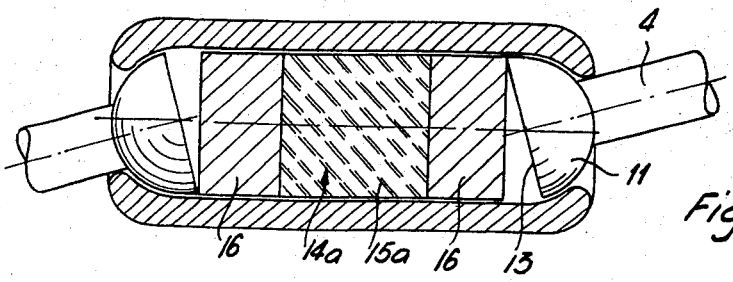
Fig. 4
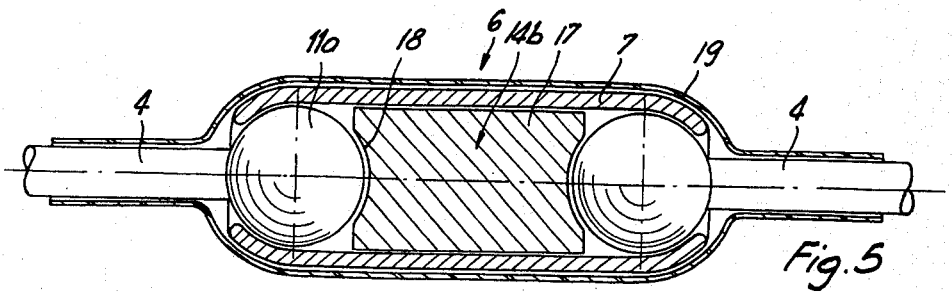
Fig. 5

ANCHOR FOR INTERCONNECTING TWO RELATIVELY MOVABLE COMPONENTS OF A STRUCTURE

BACKGROUND OF THE INVENTION

The present invention relates to a new and improved construction of anchor or anchor arrangement for interconnecting two relatively movable components of a structure, comprising two anchoring elements which are hingedly connected with one another by means of a connection element serving as compensation component and which anchoring elements in the traction or tension direction bear against fixed stops of the connection element.

In Swiss Pat. No. 441,679 there is disclosed for instance an anchor wherein the connection element serving as the compensation component consists of a helical spring which is fixedly connected with the anchoring elements. If such resilient anchor is used, for instance, for connecting an outer form of a two form wall, then the anchoring elements are fixedly embedded in a form and the compensation component is located in the hollow space or compartment between both forms of the two form wall. This known resilient anchor is disadvantageous in a number of respects. Since the forms of such a two form wall move relative to one another parallel to the wall owing to the effects of the weather and surroundings, the helical spring constituting the compensation component or part is deformed, thus introducing bending stresses in the anchoring elements and in the individual forms of the intermediate wall. This can lead to breaking out of the anchoring elements in the forms. Moreover, this resilient anchor is prone to undesired oscillation effects when forces, for instance wind forces, directed transversely to the plane of the wall act upon the outer form. As a result in the spring of the compensation component there can occur resonance phenomena. This not only leads to undesired noise, rather can also endanger the attachment of the anchoring elements in the forms and render the brickwork or masonry of the two form wall prone to fissures or cracks.

Furthermore, from the French Pat. No. 1,441,910 there is known to the art an anchor structure, the anchoring elements of which are in the form of brackets which are connected with one another hingedly via a connection element. Since the connection element is a rubber or elastomeric block it functions in the manner of the above mentioned anchor resiliently in the traction direction as well as in the compression or pressure direction, so that there can occur the already mentioned oscillation phenomena. Additionally, the anchoring elements, when not under load, are not coaxially aligned with respect to one another, so that their assembly is rendered difficult, i.e., the anchoring elements can be mounted already in a state where they are displaced towards one another, so that under certain circumstances there is eliminated a further mutual displacement in one direction.

Finally, in French Pat. No. 2,124,729 there is taught to the art an anchor of the previously mentioned type which cannot transmit compressive forces since the anchoring elements are not mutually supported at one another in the compression or pressure direction. It is therefore not suitable for interconnecting the forms of a two form wall. Also the anchoring elements, in the non-loaded state, are not aligned coaxially relative to one another, so that the anchor possesses the already above mentioned mounting or assembly drawbacks.

SUMMARY OF THE INVENTION

It is a primary object of the invention to provide an anchor of the previously mentioned type which is not associated with the above mentioned drawbacks and is especially suitable for connecting the forms of a two form wall.

With the anchor of this development it is possible to achieve this objective of the invention in that the anchoring elements are held at the stops by means of a support device, and in the unloaded state of the anchor the anchoring elements are coaxially aligned relative to one another by means of an alignment or aligning device.

Owing to the fact that the anchoring elements are held by means of the support device at the fixed stops, there are not present whatsoever any resilient elastic properties in the traction or tension direction. The support device can be rigid or resilient elastic, in which case then the support device is preferrably prebiased with such prestress against the anchoring elements that under operating loads there are practically not likewise effective any resilient elastic properties or characteristics. It is therefore possible to practically prevent oscillations or vibrations at the connection location formed by the anchor.

Due to the mutual alignment of the anchoring elements by means of the alignment device when the anchor is not loaded the assembly of the anchor is considerably simplified and there is eliminated an assembly or mounting with already displaced anchoring elements. The anchor is thus always assembled in the neutral position of the anchoring elements, so that towards the sides there is available the entire displacement path. Due to the hinged connection between the anchoring elements and the connection element, in the case of an assembled anchor and with relative movements of the components of a structure transverse to the axis of the anchor, there do not occur any bending loads in the anchoring elements and in the components of the structure, There is prevented a destruction of the anchoring elements, their attachment in the components and/or the component itself. The novel anchor is thus especially suitable for connecting the forms of a two form wall.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a side view of an anchor arranged between two forms of a two form wall;

FIG. 2 is a side view of the anchor of FIG. 1 with mutually displaced forms of the two form wall;

FIG. 3 illustrates in longitudinal sectional view and on an enlarged scale the compensation component of the anchor of FIGS. 1 and 2;

FIG. 4 is a longitudinal section of a modified compensation component of an anchor:, and FIG. 5 illustrates in lengthwise sectional view the compensation component of an anchor with modified aligning device.

DETAILED DESCRIPTION OF THE INVENTION

In the showing of FIGS. 1 and 2 an anchor 1 is spanned between two components 2 and 3, which in the embodiment under discussion are two forms of a two form wall. The anchor contains anchoring elements 4 by means of which it is attached with the forms, as well as a compensation component or part 5 which interconnects with one another the anchoring elements and allows for relative movement of the forms without any bending load.

As particularly apparent from the showing of FIG. 3 the compensation component 5 consists of a connection element 6 which is hingedly connected with the anchoring elements 4. The connection element 6 contains a cylindrical-like housing 7 with end walls 8 formed by flanges or rims, these end walls possessing spherical-shaped stops 9. The end walls further contain central openings 10 through which extend the anchoring elements 4. The latter are equipped with shoulders or projections 11 defining heads which are formed in semi-spherical manner at the sides 12 confronting the spherical shaped stops or impact members. The support surfaces 13 of the shoulders or projections 11, and which surfaces face away from the spherical-shaped stops 9, are flat or planar. At the flat support surfaces 13 of the shoulders or projections 11, and which are located perpendicular to the axis of the anchoring elements, there bears a support or supporting device 14 which prebiases the shoulders or projections 11 towards the spherical-shaped stops 9 of the housing 7. The support device 14, in the present case, possesses a spring element 15 and a sleeve formed of rubber.

Since the resilient pre-biased support device 14 bears at the flat suppport surfaces 13 of the projections or shoulders 11 of the anchoring elements 4 and presses such against the spherical-shaped stops 9 of the end wall 8 of the housing 7 it forms an aligning or restoring device or alignment means which, in the non-loaded state of the anchor, coaxially aligns relative to one another the anchoring elements 4. In this way there is ensured that the anchor in its basic position, that is to say, can be mounted or assembled with the anchoring elements aligned coaxially with respect to one another, so that there is possible the mobility of the forms in all directions transverse to the axis of the anchor. As will be seen from FIGS. 2 and 3 the forms 2 and 3 can displace towards one another parallel to the plane of the wall by an amount *a*, preferrably at least 5 millimeters, without there occurring bending stresses in the anchoring elements. The pre-stressed or pre-biased support device 14 is designed such that the anchor is practically resistant or stiff in its lengthwise direction to compressive loads, so that there is prevented the occurrance of resonance oscillations at least in a low frequency range, which such anchor could be subjected to during its use.

In FIG. 4 there is illustrated a further exemplary embodiment of a compensation component or part, the support or supporting device 14*a* of which again possesses a pre-stressed resilient element 15*a*, for instance a rubber body. This resilient element 15*a* bears at both ends via cylindrical intermediate elements 16 formed of resistant material, for instance metal, at the flat support surfaces 13 of the shoulders 11 of the anchoring elements 4. With this embodiment there is provided an aligning or restoring device with an especially large restoring moment, which retains the anchoring elements 4 in the unloaded state coaxially aligned relative to one another.

With the anchor illustrated in FIG. 5 the support device 14*b* consists of a cylinder 17, which if desired can be resilient elastic, however preferably is not resilient elastic. The cylinder bears via spherical shaped recesses 18 at ball-shaped constructed projections or shoulders 11*a* of the anchoring elements 4. As the aligning or restoring device there serves a plastic sleeve 19 which is shrunk onto the connection element 6 and the bounding portions of the anchoring elements 4 and specifically with the anchoring elements coaxially aligned with respect to one another. The shrinkage stresses of the plastic sleeve retain the anchoring elements 4 in a coaxially aligned condition, so that the anchor can be mounted in its basic position. The ball- or sphere-shaped projections 11*a* on the other hand permit of a free movement when the shrinkage stresses in the plastic sleeve 19 have been overcome for the first time. A rigid cylinder 17 renders the anchor resistent to traction and compression.

With the illustrated anchors the traction strength and compressive strength can amount to 1000 to 1500 kp. If such anchors are arranged in a two form wall, for instance with a horizontal spacing of 50 cm. at the height of the ceiling, then each anchor must secure approximately 1.5 $m^2$ wall surface. If the windloads are assumed according to SIA standards (Swiss Engineering and Architectural standards) to be 113 with 100 $kp/m^2$ pressure and suction, then each anchor is loaded with approximately 150 kp and thus possesses a 7- to 10-fold safety factor.

In contrast to the illustrated exemplary embodiments there are possible still different further constructional manifestations of the anchor.

Thus for instance the support device 14 can be a solid cylinder of rubber or a helical spring of suitable stiffness, which directly engages or through the agency of an intermediate element at the projections of the anchoring elements.

For structural elements which are only movable relative to one another in one direction, there is satisfactory an anchor whose connection element is connected via a simple joint with the anchoring elements, wherein however also in this case there is provided an aligning or alignment device for the coaxial alignment of the connection elements when the anchor is not loaded.

While there is shown and described present preferred embodiments of the invention, it is to be distinctly understood that the invention is not limited thereto, but may be otherwise variously embodied and practiced within the scope of the following claims. ACCORDINGLY,

What is claimed is:

1. An anchor for interconnecting two relatively movable components of a structure, comprising two anchoring elements each intended to be secured to one of the structure components, a compensation component for hingedly interconnecting said two anchoring elements, said compensation component having fixed stops, said anchoring elements bearing against the fixed stops of the compensation component in a traction direction of said anchoring elements, said anchoring elements having confronting ends each possessing at least a substantially semi-spherical-shaped head, said compensation component being constructed in the form of a substantially sleeve-like member which surrounds said heads in a ball-and-socket like manner, a support device arranged in said compensation component between said heads, and a restoring device provided for the compensation component and cooperating with the anchoring elements for substantially coaxially aligning the anchoring elements with respect to one another when the anchor is in an unloaded state.

2. The anchor as defined in claim 1, wherein said restoring device is defined by at least part of said support device.

3. The anchor as defined in claim 1, wherein said stops comprise flanged end portions of the compensation component.

4. The anchor as defined in claim 1, wherein the support device is a resilient element and pre-biases the anchoring elements against the stops.

5. The anchor as defined in claim 4, wherein the support device further comprises a respective substantially cylindrical intermediate element arranged between said resilient element and a respective one of the anchoring elements.

6. The anchor as defined in claim 4, wherein the restoring device possesses support surfaces provided at the heads of the anchoring elements, said support surfaces confronting the support device and being directed substantially perpendicular to the axis of the anchoring elements, the support device bearing under pre-bias at the support surfaces.

7. The anchor as defined in claim 1, wherein the restoring device comprises a plastic sleeve which is shrunkfitted over the compensation component and neighboring parts of the anchoring elements.

* * * * *